US006606100B1

(12) United States Patent
Lonoce et al.

(10) Patent No.: US 6,606,100 B1
(45) Date of Patent: Aug. 12, 2003

(54) DEVICE FOR INDICATING THE POSITION OF A WINDOW IN A DISPLAY AND FOR ENHANCING AN IMAGE IN THE WINDOW

(75) Inventors: Giovanni Lonoce, Lissone (IT); Andrea Rizzi, Venice (IT); Alberto Ramolfo, Milan (IT)

(73) Assignee: Koninklijke Philips Electronics N.V., Eindhoven (NL)

( * ) Notice: Subject to any disclaimer, the term of this patent is extended or adjusted under 35 U.S.C. 154(b) by 369 days.

(21) Appl. No.: 09/602,243

(22) Filed: Jun. 23, 2000

(30) Foreign Application Priority Data

Dec. 2, 1999 (EP) ..... 99204078

(51) Int. Cl.[7] ..... G09G 5/00

(52) U.S. Cl. ..... 345/698; 345/691; 345/694; 345/699; 345/99; 345/589

(58) Field of Search ..... 345/581, 589, 345/617, 619, 691, 698, 699, 694

(56) References Cited

U.S. PATENT DOCUMENTS 5,276,437 A * 1/1994 Horvath et al. ..... 345/620
5,500,654 A * 3/1996 Fujimoto ..... 345/634
5,978,041 A 11/1999 Masuda et al. ..... 348/563
6,292,216 B1 * 9/2001 Shimizu et al. ..... 348/177
6,310,657 B1 * 10/2001 Chauvel et al. ..... 345/790
6,313,822 B1 * 11/2001 McKay et al. ..... 345/545

FOREIGN PATENT DOCUMENTS

EP 0856829 A2 8/1998 ..... G09G/5/30
EP 0957631 A1 11/1999 ..... H04N/5/20
WO WO9921355 4/1999 ..... H04N/5/20

* cited by examiner

*Primary Examiner*—Jeffery Brier
*Assistant Examiner*—Daniel J Chung
(74) *Attorney, Agent, or Firm*—Edward W. Coudman

(57) ABSTRACT

A computer generates coordinates determining a window of display data to be displayed on a monitor. One of these coordinates may indicate the starting pixel number in a line where the window starts. The computer further generates reference information indicating a time of occurrence and a corresponding running number of a first predetermined pixel, and a time of occurrence and a corresponding running number of a second predetermined pixel of the display data. It is possible to determine, from this reference information, the instant of occurrence of the starting pixel for every running number of this pixel of the window. This has the advantage that the reference information needs to be available once only, while the instants of occurrence of several windows are determined from the coordinates of the windows and this single reference information.

3 Claims, 2 Drawing Sheets

Ta
Hs

C t0
tf
t1
tw1
tr1
tw2
tr2
t4
th
t
1
Nw1
Nr1
Nw2
Nr2
N
N

DEVICE FOR INDICATING THE POSITION OF A WINDOW IN A DISPLAY AND FOR ENHANCING AN IMAGE IN THE WINDOW

BACKGROUND OF THE INVENTION

1. Field of the Invention

The invention relates to a display data-generating device, a method of generating display data, a display apparatus, and a system comprising a display data-generating device and a display apparatus.

2. Description of the Related Art

International Patent Application WO-A-99/21355 discloses a system of a computer and a monitor for improving the image quality of selected video windows when the video information in the window is a photograph or moving video. This document states possible image quality improvements for this kind of video information: increased sharpness or contrast, gamma or color correction. However, if these image quality improvements are performed on characters and numerals, the readability will decrease. It is, therefore, required to generate information in the computer to provide the monitor with the position of the window, only inside which the image quality improvement has to be performed.

In an embodiment, the position information comprises a first pulse signal which corresponds to the width in the horizontal direction of the window, and a second pulse signal which corresponds to the width in the vertical direction of the window. It is mentioned that this approach has the drawback that a separate wire connection is required between the computer and the monitor. Therefore, in the other embodiments disclosed, marker signals are generated in the video information which is transported from the computer to the monitor to indicate the start and the end position of the window. It is a drawback that these marker signals are permanently visible for every window.

SUMMARY OF THE INVENTION

It is, inter alia, an object of the invention to generate information indicating a position of a window, this information being less visible.

To this end, a first aspect of the invention provides a display data-generating device for generating window position indicating data. A second aspect of the invention provides a method of generating display data indicating a position of a window. A third aspect of the invention provides a display apparatus for use with such a display data generating device. A fourth aspect of the invention provides a system comprising such a display data-generating device and such a display apparatus.

The display data-generating device (for example, a computer), in accordance with a first aspect of the invention, generates display data (also referred to as video information) to be displayed on a display device (for example, a computer monitor). The display data-generating device further generates coordinates determining a window of the display data. One of these coordinates may indicate, for example, the starting pixel number in a line where the window starts. The display data-generating device further generates reference information indicating a time of occurrence and a corresponding running number of a first predetermined pixel, and a time of occurrence and a corresponding running number of a second predetermined pixel of the display data. It is possible to determine, from this reference information, the instant of occurrence of a pixel for every given running number of this pixel (for example, the starting pixel number of the window). This has the advantage that the reference information needs to be available only once, while the instants of occurrence of several windows are determined from the coordinates of the windows and this single reference information. This will become clear, in more detail, after elucidation of the operation of the display apparatus in accordance with the third aspect of the invention. The display data, the coordinates, and the reference information are provided at an interface which may be, for example, a standard VGA connector.

The display apparatus, in accordance with the third aspect of the invention, comprises a picture enhancement circuit which, under the control of a control signal generated by a control circuit, enhances the picture quality of video information displayed within a window. The control circuit receives the reference information and the coordinates determining the window. The relation between the running number of a pixel and its instant of occurrence can be determined from the reference information. For example, the distance in time between two consecutive pixels can be determined from the time of occurrence and a corresponding running number of a first predetermined pixel, and the time of occurrence and a corresponding running number of a second predetermined pixel. Consequently, it is possible to.determine the instant of occurrence of the start of an arbitrary window from the running pixel number indicating the start of this window by multiplying the difference in running numbers between one of the predetermined pixels and the window start pixel with the distance in time between two consecutive pixels.

The invention is applicable to the horizontal position of pixels in a line of a field of the display data, or to a vertical position of lines in the field. If transposed scanning is applied, whereby lines which are written in the vertical direction succeed each other in the horizontal direction, the words vertical and horizontal in the previous sentence should be exchanged.

It is important to translate the running numbers of pixels into instants of occurrence because there is no one-to-one link between the timing of the video data pixels supplied by the display data-generating device and the instant of occurrence (which determines the position on the display screen) of these pixels in the display device. For example, in the line direction, the active line period is defined as the period of time from the first pixel in a line up to the last pixel in the line. The total line period is the sum of this active line period during which the video information is displayed and a blanking period during which no video information is displayed. The total line period is also referred to by its reciprocal: the line frequency. In a display apparatus with a cathode ray tube, a major part of the blanking period is used for the flyback of the horizontal deflection from the end of the active video period (the end position of the visible video, usually near the right edge of the picture tube screen) to the start of the active video period (the start position of the visible video, usually near the left edge of the picture tube screen) of the next line. In current computer monitors, it is required to be able to display several graphical resolutions which give rise to several different line frequencies. As the minimal flyback time is limited, the ratio between the active line period and the blanking period differs for different line frequencies, and, therefore, it is not known when the first active video sample exactly occurs with respect to the horizontal synchronization pulse which is the only horizontal position information supplied by the computer and available in the monitor. Consequently, the extra reference information is required to determine the instant of occurrence of the window from the window coordinates.

The window coordinates may comprise a first running number indicating the horizontal start position of the window, a second running number indicating the vertical start position of the window, a third running number indicating the horizontal end position of the window, and a fourth running number indicating the vertical end position of the window. It is also possible to provide running numbers indicating the horizontal and vertical start positions and further information indicating a period of time between the respective start and end positions.

In one embodiment of the invention describing a preferred solution, the first predetermined pixel is the start pixel of the active line period, and the second predetermined pixel is the last pixel of the active line period. Now, the reference information only needs to comprise the time of occurrence of these first and last pixels, and the total number of pixels in a line period.

In another embodiment of the invention, the reference timing information, which indicates the time of occurrence of the first and the second predetermined pixel, is encoded in the display data. This has the advantage that this information is transported between the computer and the monitor via a standard interface without the need for an extra wire.

In another embodiment of the invention, the reference timing information is an analog signal having a level change at the instants of occurrence of both the first and the second predetermined pixel. For example, a first pulse is generated with a rising edge at the instants of occurrence of the first predetermined pixel, and a second pulse is generated with a rising edge at the instants of occurrence of the second predetermined pixel. Or, alternatively, all pixels of a line have a high level. The reference information may be encoded in one or more of the red, green, and blue data signal.

In another embodiment of the invention, the reference timing information is encoded in one line of a field. In this way, the visibility of the reference timing information is minimized. In a preferred embodiment, this line is the last line of a field.

In another embodiment of the invention, a software driver of the graphics adapter instructs the operating system (for example, Windows 98®) that the resolution format of the display data supplied by the graphics adapter has a predetermined number of lines which is smaller than are actually available. These reserved lines are used to transport the reference information or the reference timing information. The predetermined number depends on how many lines are required to transport the information. In this way, the transported information will not be disturbed by the operating system or application software running under the operating system, because the reserved lines are not available for both the operating system and the application software.

In another embodiment of the invention, the window coordinates are transported from computer to monitor via a digital bus.

In another embodiment of the invention, the running numbers indicating the first and the second predetermined pixel or the total number of pixels in a line period are transported via the digital bus.

In another embodiment of the invention, the coordinates of the window and the running numbers indicating the first and the second predetermined pixel or the total number of pixels in a line period are encoded in at least one of the data signals.

In another embodiment of the invention, the visibility of the reference timing signal is further minimized by displaying the reference timing signal only during a very short time required by the monitor to extract the information for use. The reference timing signal is only required during start-up of the display apparatus or after a change of the graphic resolution of the video data supplied by the display data-generating device.

In another embodiment of the invention, a detector determines whether the nature of the video content in a window is of such a kind that video enhancement will improve the performance. The window(s) coordinates information is only sent to the monitor if at least one window is present with a nature of the video content for which an improvement is possible. In this manner, the window(s) coordinates information is only sent to the monitor when required and the visibility of this information is further minimized.

In another embodiment of the invention, an indication of the nature of the video content in a window is sent to the monitor to enable the monitor to perform a picture enhancement processing optimally fitting this nature.

In another embodiment of the invention, a very simple relation determines the relation between the instants of occurrence of the start instant of a window and the instants of occurrence of the first and last pixel in the active line period and the total number of pixels in an active line period.

In another embodiment of the invention, the enhanced display signals are blanked during the video lines which comprise the reference information or the reference timing information. In this way, the lines comprising this information will not be visible to the user.

In another embodiment of the invention, the peaking properties of the peaking performed on the data in the window are dependent on the line frequency to obtain an optimal performance improvement.

In another embodiment of the invention, the white color temperature of the data in the window is adapted in accordance with a desired white color as determined from the video properties and provided by the computer, or as desired and inputted by the user.

In another embodiment of the invention, the contrast and/or brightness of the data in the window is adapted in accordance with a desired setting as determined from the video properties and provided by the computer, or as desired and inputted by the user.

In another embodiment of the invention, the gamma of the data in the window is adapted in accordance with a desired gamma as determined from the video properties and provided by the computer, or as desired and inputted by the user.

These and other aspects of the invention are apparent from and will be elucidated with reference to the embodiments described hereinafter.

DESCRIPTION OF THE PREFERRED EMBODIMENTS

Figure 1:
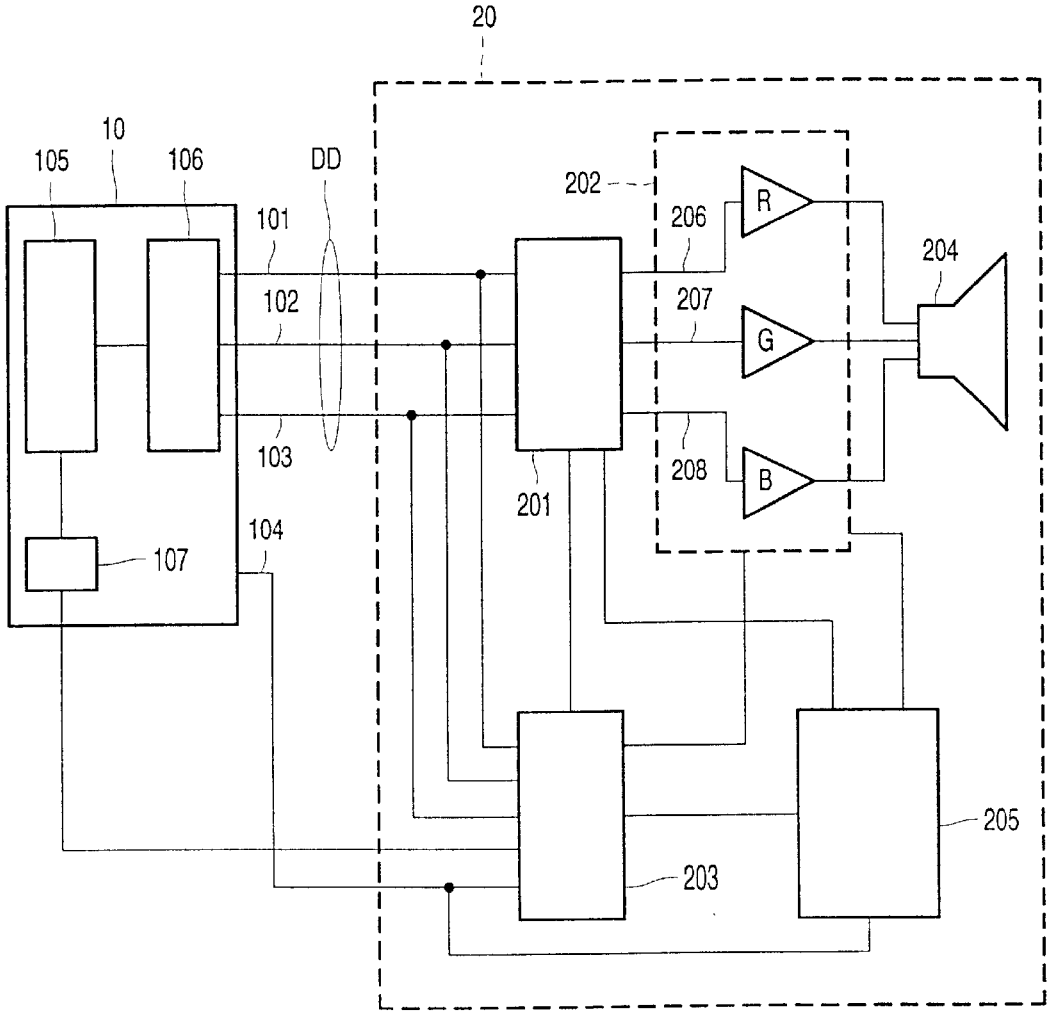
FIG. 1 shows a system of a display data-generating device and a display apparatus in accordance with the invention.

FIG. 1 shows a display data generating device 10 and a display apparatus 20. The display data generating device 10 may be a computer, and the display apparatus 20 may be a computer monitor.

The display data generating device 10 comprises a display data generator 106, a microprocessor 105, and an optional digital bus driver 107.

The microprocessor 105 controls the display data generator 106 (for example, a computer graphics adapter) to send a video signal 101, a video signal 102, a video signal 103, and horizontal and vertical synchronizing pulses 104 to the display apparatus 20. Usually, the video signals 101, 102, 103 represent the three primary colors red, green, and blue, respectively. The two synchronizing signals 104,can be either sent separately or combined through one wire.

As discussed before, the reference information comprises instants of occurrence and running numbers of a first and a second predetermined pixel. This reference information and the window coordinates are generated by the microcomputer 105. There are many possibilities to transport the reference information and the window coordinates from the display data generating device 10 to the display apparatus 20. For example, the instants of occurrence of the first and the second predetermined pixels may be encoded as level transitions in at least one of the analog video signals 101, 102, 103. The microprocessor 105 may further control the optional digital bus driver 107 to send control data DB to the display apparatus comprising the running numbers of the first and the second predetermined pixels and the window coordinates. It is also possible to encode the complete reference information and the window coordinates in the analog video signals 101, 102, 103.

The display apparatus 20 comprises a picture enhancement circuit 201, a video amplifier 202 divided into three sections R, G and B, a display device 204, a windows manager circuit (further referred to as WMC) 203, and a microprocessor 205. Although FIG. 1 shows a cathode ray tube as display device 204 driven by a video amplifier 202, the invention is also useful in combination with other display devices (for example, LCD or plasma panels) which are driven in another way. By way of example, the invention will be further explained with reference to the computer 10 and cathode ray tube monitor 20 shown in FIG. 1.

In a conventional monitor, the three video signals 101,102 and 103 are sent directly to the video amplifier 202 for the appropriate amplification up to the level required for driving the display device 204.

In the present invention, the three video signals 101, 102 and 103 are processed by the picture enhancement circuit 201 which is controlled by the WMC 203 and the microprocessor 205. The video amplifier 202 amplifies the processed video signals 206, 207 and 208.

The picture enhancement circuit 201 can accomplish various functions whose purpose is to provide a picture in the selected window(s) which is more pleasant or impressive to the user.

Some examples of picture enhancement are described hereinafter.

A first example is the sharpness boosting function (further referred to as SBF). The SBF adds a peaking to the three video signals 101, 102 and 103 when the picture enhancement circuit 201 receives the command from the WMC 203 to do so. In other words, the three video signals receive an over-amplification only in the higher harmonics. The result of this processing is a much crisper picture on the screen. The time constant of the peaking may be determined by the microprocessor 205 which, knowing the line frequency of the monitor via the input synchronizing signals 104, decides what is the best peaking for this video information, and, accordingly, provides instructions to the picture enhancement circuit 201.

In another example of video processing in selected windows to obtain picture enhancement, the white color temperature is adapted.

It is common practice to express the color of white in terms of "white color temperature", with reference to the real temperature a black body would have to produce that particular color. For example, the white color of "computer images" (like texts or graphics) is usually set around 9300° K., while the white color in a television apparatus is set around 6500° K.

Once the monitor is adjusted to display a predetermined white color, for example, 9300° K., all the pictures on the screen will be displayed in that white color, even if this white color is not well suited to all the images present on the screen at the same time. For example, when a multi-windows picture is displayed on a monitor adjusted to display a white color of 9300° K., wherein one window shows a photo and another window shows a spreadsheet, the photo window will be penalized because the colors of the image will be much "colder" and not so vivid as in real life. In contrast, when the monitor is set at 6500° K., an unsightly pink background will spoil the spreadsheet picture.

As is known, all the colors of a picture are derived from a mix of three primary colors: red, green and blue. In theory, the white color is achieved from an equal mix of the three primaries (33% each). In reality, the white mix is made up of different contributions of the three primaries in order to render the light more or less "warm" (or "cold"), depending on the applications. The picture enhancement circuit 201 can also incorporate the color temperature change function (further referred to as CTC) which adapts the color in the selected windows to optimally fit the nature of the video content of the window. If, for example, a video clip is running in a certain window, the CTC automatically adjusts the white color to 6500° K. If a photo is being displayed, the CTC will switch to 5000° K., and so forth. The various color temperatures can be fully programmed by the user via the OSD (on-screen display menu) or another UI (user interface).

The CTC can be realized either by changing the level of the three processed video signals 206, 207, 208 sent to the video amplifier 202, or by changing the ratio of the gains of the three amplifiers R, G, B.

As the optimal picture enhancement function depends on the data content of the window, an identification of the video content is necessary to decide where (and where not) to apply the processing. For example, photographs and films having a higher brightness (contrast) and/or sharpness are more pleasant to the human eye. On the other hand, the same treatment applied to other kinds of pictures, such as text or graphics, shows unacceptable artifacts to the professional user of the monitor. This identification may be performed manually by the user by selecting a window, and by selecting the enhancement function to be activated. It is also possible that the computer 10 provides information to the microprocessor 205 about the nature of the display data. For example, the microprocessor 105 in the computer 10 may detect which application is running in a window and, if this application is a picture viewer, indicate to the monitor that a picture is being displayed.

Figures 2A, 2B, 2C, 2D:
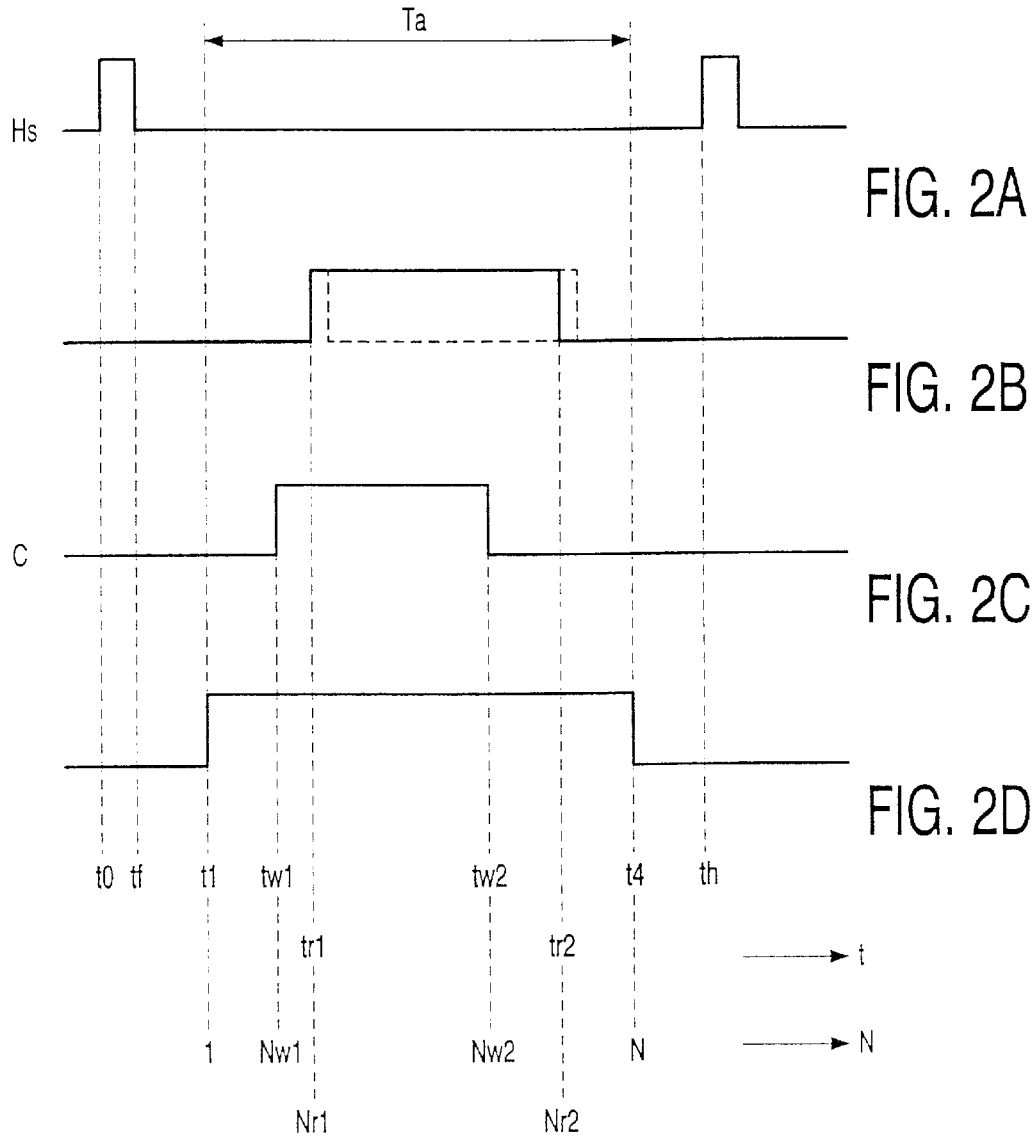
FIGS. 2A to 2D show signals for elucidating the operation of the system shown in FIG. 1.

FIGS. 2A–2D show signals for elucidating the operation of the system shown in FIG. 1. FIG. 2A shows the horizontal synchronization pulse Hs. FIG. 2B shows the reference timing information which indicates the time of occurrence tr1, tr2 of the first and a second predetermined pixel Nr1, Nr2. FIG. 2C shows a control signal indicating to the picture enhancement circuit 201 when the enhancement function has to be active. FIG. 2D shows one of the video signals 101, 102, 103 when a full white line is displayed.

The picture enhancement circuit 201 must be controlled by an electric signal perfectly in phase with the windows to be enhanced. Without adequate means, the user would have to manually phase the area to be processed with the selected window. Moreover, when the user works with a multi-sync monitor, he should perform this phasing operation whenever he wants to change the resolution on the screen. This would be very cumbersome. Therefore, a circuit should be provided which automatically keeps the right phase between the areas to be processed and the selected windows. An aspect of the invention provides such a circuit wherein the reference information, which allows an automatically correct phase, is as little visible as possible.

The spatial position of a window on the screen is determined in the monitor 20 by the time phase with respect to the synchronizing signals 104. For the sake of simplicity, the principle will be explained only for the horizontal deflection of the monitor 20. The same may be applied, mutatis mutandis, to the vertical direction.

FIG. 2A represents the horizontal synchronizing signal 104 supplied to the monitor 20, with the active part of the horizontal synchronizing signal 104 lasting from the instant t0 to the instant tf. The horizontal frequency fh of the monitor 20 is given by:

$$fh=1/(th-t0).$$

The active video period Ta starts at the instant t1 with the first pixel in a line with pixel number 1, ends at instant t4 with the last pixel in a line with pixel number N (for example, 1024). FIG. 2D represents the active video signal of one of the video signals 101, 102, 103 when all pixels in a line have the same predetermined value. The first pixel of all three video signals 101, 102, 103 starts at the same instant t1 and the last pixel of all three video signals 101, 102, 103 ends at the same instant t4. The time period between tf and t1 is called the "back porch", and the interval of time between t4 and th is called the "front porch". FIG. 2C shows the control signal C which must be perfectly in phase with the selected window on the screen for controlling the picture enhancement circuit 201 to perform the enhancement function on exactly the video data within the window.

To elucidate the operation of the circuit shown in FIG. 1, let it be assumed, by way of example, that there is a video format of 1024×768 pixels, and that the window to be processed starts at pixel number 300 and ends at pixel number 700.

As is shown in FIG. 2:

- t1 (start of the active video signal) corresponds to pixel number 1,
- tw1 (start of the window) corresponds to pixel number 300,
- tw2 (end of the window) corresponds to pixel number 700, and
- t4 (end of the active video signal) corresponds to pixel number 1024.

In order to process the video signal in the window starting at pixel number 300 and ending at pixel number 700, the display data-generating device 10 should provide the information of the temporal position of the window with respect to the synchronizing pulse Hs or at least where the first pixel with number 1 is located in time with respect to the horizontal synchronizing pulse Hs.

Unfortunately, this is not the case without special provisions because, although all the timing information is generated in the graphics adapter of the display data-generating device 10, this information is stored in registers which are not easily accessible and are video-card dependent. Furthermore, this information cannot be derived from the signals 101, 102, 103, 104 supplied by the display data-generating device 10 because the video signals 101, 102, 103 depend on the video content. Due to the unpredictable content of the video signals 101, 102, 103, it is not possible to reliably determine the instant of occurrence t1 of the first pixel in a line with respect to the instant t0 of occurrence of the synchronizing pulse 104.

The problem is even more serious in multi-sync monitors, where, even when the horizontal frequency may be the same for the same format, the back porch and the front porch very often have different values.

An embodiment of the invention is based on the recognition that the video signals 101, 102, 103 can be used to generate the necessary reference timing information by forcing the graphics adapter 106 to generate, during a predetermined line, a timing signal which is used as reference for all the time relations.

The timing information may consist of a timing signal with a first level transition at a first predetermined pixel with running number Nr1 occurring at a first predetermined instant tr1, and a second level transition at a second predetermined pixel with running number Nr2 occurring at a second predetermined instant tr2. Examples of such a timing signal are shown in FIG. 2B. The solid line shows a single pulse, the dashed line shows two pulses. The period of time between two pixels can be calculated from the period of time between these two instants tr1, tr2 and the running numbers Nr1, Nr2. The start instant tw1 of the window is determined by multiplying the number of pixels occurring between the running number Nw1 of the start pixel of the window and one of the running numbers Nr1, Nr2 of the predetermined pixels as follows:

$$tw1=tr1+(Nw1-Nr1)*(tr2-tr1)/(Nr2-Nr1+1)$$

when using the time difference between the start pixel of the window Nw1 and the first predetermined pixel Nr1. A similar equation results when the time difference between the start pixel of the window Nw1 and the second predetermined pixel Nr2 is used. The equations of both cases can be rewritten as follows:

$$tw1=((Nr2-Nw1)*tr1+(Nw1-Nr1)*tr2)/(Nr2-Nr1+1).$$

As the equations are mathematically identical, it is, of course, not relevant which equation is used to determine the start instant of the window. The term (Nr2−Nr1+1) includes a 1 because the first pixel has a running number 1. When the running number of the first pixel is selected to be zero, this term will read (Nr2−Nr1). The first and second predetermined pixels may occur in one and the same line of the video information to allow determination of the horizontal start (and/or end) position of the window. The first and second predetermined pixels may occur in different lines of the video information to allow determination of the vertical start (and/or end) position of the window.

In a preferred embodiment, the first predetermined pixel Nr1 is the start pixel of a line with running number 1 and occurring at a relative instant zero, and the second predetermined pixel Nr2 is the last pixel of a line with running number N and occurring at a relative instant Ta. Now, the instant of occurrence tw1 of a pixel with a running pixel number Nw1 is defined by:

$$tw1=Nw1*Ta/N.$$

By way of example and for the sake of simplicity, the invention will be further elucidated with respect to this preferred embodiment.

The invention, according to the preferred embodiment, comprises three parts: a software module resident in the computer 10, a piece of software resident in monitor 20, and hardware located in the monitor 20.

The software located in the PC extracts information about the resolution format which is being used, and the coordinates of the window(s) from the operating system.

The coordinates of the window can be extracted either automatically, by recognizing the kind of content of the video (for example, a text or a photo), or manually by clicking with a mouse on the desired window.

The software located in the PC forces the graphics adapter 106 to generate a full white (or red, green, or blue, or any combination) line picture ("burst-line") when a certain command is activated. The time during which this line is present is limited to the time required by the WMC 203 located in the monitor 20 to acquire the information so as to be able to generate the window-pulse or control pulse C, as will be explained hereinafter.

In the PC, all the information is encoded and embedded in at least one of the video signals 101, 102, 103 or is sent to the bus driver 107 for the transmission (using USB, DDC or the like).

If the embedding choice is made, all the information can be transmitted during one single line ("data-line"), utilizing the fact that there are three video channels. For example, the green channel can carry the burst-line and the red/blue channel can carry the window coordinates.

A problem that might arise is the possible (but very unlikely) interference with the application running in the PC. In fact, the application running in the PC might decide to write some information just at the same time the burst-line is being generated. In this case, the information sent to the monitor would not be correct. This problem is solved in the following two ways.

The first (and simplest) way is to blank the at least one line which is carrying the encoded information before it is displayed on the display screen of the monitor. Of course, before the blanking is performed, the (encoded) reference timing information has been retrieved first. The drawback of this solution is that the user loses at least one line of information. On the other hand, when this at least one line is positioned at the bottom of the picture, this loss is hardly visible. The line (or lines) containing the reference timing information are detected in the WMC 203 and blanked in the picture enhancement circuit 201.

In a second approach, usually at the start-up of the operating system, such as Windows®, the operating system sends a call to the graphics adapter driver, asking for some information necessary to deploy the picture on the screen. One piece of this information is the format resolution (for example, 1024×768). According to this second way, the software will execute the following steps:

(1) intercept the call and the request of information to the driver, (2) intercept the information sent by the driver, (3) modify the information regarding the format resolution by decreasing the number of lines by one or more, depending on the number of lines carrying the encoded information, and (4) send the modified information to the operating system.

In this way, one (or more) lines (the most convenient are the last lines) are not accessible to the operating system and can thus be fully utilized to transmit the information. For example, if the original format was 1024×768, the picture will actually be drawn on the screen in a format of 1024×767 pixels, without any loss of information.

The basic purpose of the piece of software resident in the monitor (firmware) is to execute all the calculations for deriving the temporal position of the selected window(s) on the basis of the information transmitted by the computer.

The WMC 203 performs the following operations:

(a) decoding of the signal sent by the computer 10 either embedded in the video signal 101, 102, 103, or travelling on a communication bus driven by the digital bus driver 107, and (b) generating a control signal as shown in FIG. 2C whose duration and phase correspond to the duration and phase of the window(s) selected by the user.

It should be noted that the above-mentioned embodiments illustrate rather than limit the invention, and that those skilled in the art will be able to design many alternative embodiments without departing from the scope of the appended claims. Use of the verb "comprise" and its conjugations does not exclude the presence of elements or steps other than those listed in a claim. The invention can be implemented by means of hardware comprising several distinct elements, and by means of a suitably programmed computer. In the device claim enumerating several means, several of these means can be embodied by one and the same item of hardware.

In summary, in a preferred embodiment of the invention, a computer generates coordinates determining a window of display data to be displayed on a monitor. One of these coordinates may indicate the starting pixel number in a line where the window starts. The computer further generates reference information indicating a time of occurrence and a corresponding running number of a first predetermined pixel, and a time of occurrence and a corresponding running number of a second predetermined pixel of the display data. It is possible to determine, from this reference information, the instant of occurrence of the starting pixel for every running number of this pixel of the window. This has the advantage that the reference information needs to be available once only, while the instants of occurrence of several windows are determined from the coordinates of the windows and this single reference information.

What is claimed is:

1. A display data generating device comprising:

means for providing display data;

means for generating reference information indicating a first time of occurrence and a corresponding first running number of a first predetermined pixel, and a second time of occurrence and a corresponding second running number of a second predetermined pixel of the display data; and means for generating coordinates determining a window of the display data, characterized in that the means for providing display data, the means for generating reference information, and the means for generating coordinates together comprise a microprocessor and a graphics adapter, the microprocessor being programmed to:

control the graphics adapter to provide the display data; and generate the reference information and the coordinates, the microprocessor is further programmed to encode reference timing information in the display data, the reference timing information indicating the first time of occurrence of the first predetermined pixel, and the second time of occurrence of the second predetermined pixel, the display data comprises a red, a green and a blue data signal, the graphics adapter supplies, in at least one of the data signals, the reference information as a first signal transition at the first time of occurrence of the first predetermined pixel, and as a second signal transition at the second time of occurrence of the second predetermined pixel, and the microprocessor is further programmed to control the graphics adapter under the control of a software graphics adapter driver, said software graphics adapter driver performing the steps:

intercepting a call from an operating system to the graphics adapter requesting the resolution format of the display data, the resolution format comprising an indication of a number of lines in a field of the display data;

intercepting the resolution format supplied by the graphics adapter in response to the call from the operating system;

modifying the resolution format supplied by the graphics adapter by decreasing said number of lines by a predetermined number corresponding to a number of video lines encoded to comprise the reference timing information; and providing the modified resolution format to the operating system.

2. A display apparatus comprising:

a display device;

a picture enhancement circuit for receiving display data and a control signal and for supplying enhanced display signals to the display device during a period of time indicated by the control signal; and a control circuit for receiving:

reference information indicating a first time of occurrence and a corresponding first running number of a first predetermined pixel, and a second time of occurrence and a corresponding second running number of a second predetermined pixel of the display data, and coordinates determining a window of the display data, said control circuit supplying the control signal indicating a start instant of the window, the start instant being calculated from the coordinates and the reference information, characterized in that the control circuit determines the start instant (tc1) as $$tc1=((Nm2-Nc1)*tm1+(Nc1-Nm1)*tm2)/(Nm2-Nm1),$$

where Nm1 is the first running number, Nm2 is the second running number, Nc1 is a first of said coordinates, tm1 is the first time of occurrence, and tm2 is the second time of occurrence.

3. A display apparatus comprising:

a display device;

a picture enhancement circuit for receiving display data and a control signal and for supplying enhanced display signals to the display device during a period of time indicated by the control signal; and a control circuit for receiving:

reference information indicating a first time of occurrence and a corresponding first running number of a first predetermined pixel, and a second time of occurrence and a corresponding second running number of a second predetermined pixel of the display data, and coordinates determining a window of the display data, said control circuit supplying the control signal indicating a start instant of the window, the start instant being calculated from the coordinates and the reference information, characterized in that the first predetermined pixel is the first pixel in a line, and that the second predetermined pixel is the last pixel in said line, the first time of occurrence being the time of occurrence of the first pixel, the second time of occurrence being the time of occurrence of the last pixel, and the reference information indicating a total number of pixels occurring in said line, and the control circuit determines the start instant (tc1) as $$tc1=Nc1*T/N$$

wherein Nc1 is the first running number, the line period T is the duration of a video line from the first video pixel to the last video pixel, and N is the number of video pixels occurring during the line period T.

* * * * *